United States Patent [19]

Miller

[11] 4,386,664

[45] Jun. 7, 1983

[54] METHOD FOR GUIDING ROTARY DRILL

[75] Inventor: Thomas R. Miller, Waynesburg, Pa.

[73] Assignee: Conoco Inc., Ponca City, Okla.

[21] Appl. No.: 163,245

[22] Filed: Jun. 26, 1980

[51] Int. Cl.[3] ..... E21B 7/04

[52] U.S. Cl. ..... 175/45; 175/62; 299/12

[58] Field of Search ..... 175/45, 61, 62

[56] References Cited

U.S. PATENT DOCUMENTS

| | | | |
|---|---|---|---|
| 2,646,253 | 7/1953 | Johnston | 175/61 |
| 2,646,254 | 7/1953 | Johnston | 175/61 |
| 4,015,673 | 4/1977 | Craig, Jr. | 175/61 |
| 4,108,256 | 8/1978 | Moore | 175/61 |

OTHER PUBLICATIONS

Bureau of Mines Report, U.S. Department of the Interior, *Rotary* Drilling Holes in Coalbeds for Degasification by Joseph Cervik, 1975, pp. 1–21.

*Primary Examiner*—James A. Leppink
*Assistant Examiner*—William P. Neuder
*Attorney, Agent, or Firm*—Richard W. Collins

[57] ABSTRACT

A method of controlling the direction of a generally horizontal borehole drilled with a rotary drilling unit in a subterranean formation such as a coal seam. The method comprises predetermining drilling conditions for the formation being drilled and the equipment being utilized which will provide an upward buildup to the borehole trajectory, a downward change in trajectory, or a substantially level borehole trajectory. The predetermined conditions include the number of drill bit revolutions per unit length of borehole drilled. Periodic borehole surveys indicate to an operator which set of drilling conditions should be utilized for the next increment of hole drilled to maintain the hole within the boundaries of the formation being drilled.

2 Claims, No Drawings

METHOD FOR GUIDING ROTARY DRILL

BACKGROUND OF THE INVENTION

This invention relates to the drilling of generally horizontal boreholes in subterranean formations, and more particularly to an improved method to controlling such a borehole as it is drilled to maintain it within the upper and lower boundaries of the formation being drilled. The invention is particularly applicable to drilling of degasification boreholes in coal seams in advance of mining to reduce the methane concentration in the working area during mining of the coal seam.

The use of rotary drilling to form long horizontal gas relief holes in coal beds is known in the art as a means for degasifying a coal bed in advance of mining. These gas relief holes are either vented or connected to a vacuum source to remove methane from the coal bed. The greatest problem encountered in drilling these gas relief holes is that of maintaining the bit trajectory parallel to the coal bed such that the resulting holes are actually through the coalbed rather than through an underlying or overlying formation.

It is often desirable in degasifying a coal bed to drill a series of gas relief holes for distances of 300 meters or more into the coal bed. Maintaining the bit on a horizontal trajectory parallel to the bedding planes of the coal bed is difficult. The natural tendency of the bit during horizontal drilling is to arch downward due to the forces of gravity. Other factors such as inclusions in the coal bed may cause the bit to tend to deviate from the plane of the coal bed.

Prior to this invention, there were several approaches taken to maintain the bit trajectory along the desired path. The primary factors affecting the direction of drilling are bit thrust and bit rotational speed. As a general rule, decreased thrust and increased rotational speed tend to cause a downward bit trajectory, while increased thrust and reduced rotational speed tend to cause an upward trajectory. Other factors such as formation hardness, bit type and drill rod weight can affect the trajectory of a borehole. An experienced operator must consider the above as well as other factors in controlling the trajectory of a borehole.

There are known methods for determining the position of a borehole relative to the boundaries of a coal bed. These methods are quite effective, but they are time consuming and expensive, and any drilling process which can reduce the number of borehole surveys necessary is much to be desired.

The state of the art to which the present invention pertains is set forth in detail in a *Bureau of Mines Report of Investigations* published in 1975, numbered 8097 and entitled "Rotary Drilling Holes in Coalbeds for Degasification," by Cervick et al, available in the U.S. Department of Interior library. That report describes the use of rotary drill bits attached to drill rods and maintained in a desired trajectory by a combination of bit thrust, rotational speed and drill rod stabilizer spacing. That report further notes that locating a stabilizer near the drill bit will cause a slight upward trajectory to the bit with proper drill thrust and bit rotational speed, and further notes that a downward trajectory can be obtained by locating a stabilizer several meters behind the bit. However, relocating a stabilizer to facilitate a change in bit trajectory due to change in bed dip or to the bit straying out of the coal bed for any reason involves removal of the entire drill string. Such a procedure is time consuming and unproductive.

More recently, attempts have been made to avoid the need for frequent removal of the drill string to relocate stabilizers. A device for accomplishing this is described in U.S. Pat. No. 4,108,256.

While the prior art devices and techniques have been successful to some extent in controlling the trajectory of generally horizontal boreholes in subterranean formations, there has been a continuing need for an improved method of accomplishing this objective in a manner which can be readily taught to unskilled operators, utilizing uncomplicated equipment.

SUMMARY OF THE INVENTION

According to the present invention, the trajectory of a rotary drill bit in a subterranean formation is controlled by predetermining the drill bit revolutions per unit length of borehole drilled which will give an upward and a downward buildup or change in the borehole trajectory, and then utilizing the appropriate value of revolutions per unit length of borehole drilled to maintain the borehole within the upper and lower boundaries of the formation.

It is an object of the present invention to provide an improvement for drilling generally horizontal boreholes through subterranean formations.

It is a further object to provide such a method which will enable an operator to maintain a borehole within the upper and lower boundaries of a subterranean formation utilizing a technique which has only one variable.

The accomplishment of the foregoing as well as other objects and advantages is obtained by the present invention, and will be apparent from consideration of the following detailed description thereof.

DESCRIPTION OF THE PREFERRED EMBODIMENT

The method of controlling the direction of a generally horizontal borehole in accordance with this invention involves first predetermining a set of drilling conditions for the particular formation being drilled and the specific equipment being utilized which will provide a known trajectory to the borehole. In some cases, conditions for obtaining a slight upward change and a slight downward change are obtained, and one or the other set of conditions is utilized to provide a wavelike trajectory within the boundaries of the formation being drilled. Periodic borehole surveys are taken to check that the borehole is being maintained within the formation.

The drilling conditions which are predetermined in accordance with the invention include the number of drill bit revolutions per unit length of borehole drilled. It has been found that for a given formation and a particular drilling apparatus, a value for drill bit revolutions per unit length of borehole can be determined which will reliably provide an upward or a downward buildup or change in the borehole trajectory. In some cases, a value for drill bit revolutions per unit length of borehole can be determined which will provide a straight or level trajectory, but this value is more sensitive and less reliable than the values for obtaining either an upward or downward change, such that in many cases it is preferred only to use a known value for providing an upward change alternatively with a known value for providing a downward change.

A drilling procedure in accordance with the invention will now be described. A rotary drilling unit including a first stabilizer five meters behind the bit and a second stabilizer immediately behind the bit is utilized to drill a borehole through a horizontal coal seam. During the first 30–40 meters of drilling, a series of borehole surveys utilizing known instruments which provide information relating to borehole position and trajectory can establish drilling conditions including the revolutions per unit length needed to provide both an upward and a downward change to the borehole trajectory. Having established this, it is subsequently possible to take borehole surveys only every 20 meters or so, whereas without the process of this invention it was generally necessary to take a borehole survey every 3 to 5 meters in order to maintain the borehole between the bedding planes of a coal bed.

In determining the conditions to provide either upward or downward change in the borehole trajectory, typically a drill bit revolution speed is fixed, such as at 500 rpm, and sufficient thrust is utilized to give a target penetration rate such as 2 meters per minute. This would provide a bit revolution per meter of 250. The borehole survey would indicate that for this value of revolutions per unit length the borehole has an upward buildup. Subsequently, a thrust sufficient to provide 0.5 meters per minute of penetration would be utilized. This would give a value for bit revolutions per meter of 1000, and the borehole would turn downward. Having determined these values for bit revolutions per meter to give an upward or downward change in trajectory, the operator subsequently only has to monitor the penetration rate to provide an assured upward or downward change in trajectory. As mentioned above, the drilling conditions required to give a flat trajectory are more difficult to obtain, and are less reliable than the above-noted predetermined conditions for obtaining an upward or downward trajectory, such that normally it is preferred to drill with a known alternating upward and downward trajectory rather than trying to maintain a flat trajectory.

In a near ideal case, it would be possible to start a borehole in the center of a 2 meter coal seam and maintain it within $\pm 0.5$ meters of the center. In most cases, conditions that will provide an angle change of about 0.5 to 1.5 degrees per 10 meters of borehole are satisfactory. Conditions that provide this rate of change in upward and downward angle are alternately used to provide a wavelike borehole trajectory within a seam. In cases where the seam changes in pitch, or where a survey shows that for some reason the borehole is approaching a seam boundary, conditions that provide a faster change of borehole angle may be required. A lower value for revolutions per unit length than that normally used to provide an upward change would provide a faster change in upward angle, and a higher value than that normally used to provide a downward change would provide a faster change in downward angle.

It will be appreciated that utilizing this invention requires predetermining the drilling conditions required to give the desired trajectory, and these conditions will vary depending on the equipment being utilized and the type of formation being drilled. However, once these values have been obtained, they are very reliable and reproduceable, and can be utilized by an operator with a minimum of training to provide a predictable borehole trajectory through the formation.

In some cases, a different drill bit revolution speed may be used for the upward and downward portions of the drilling. This only requires a simple adjustment in penetration rate to provide the desired number of drill bit revolutions per unit length of borehole being drilled, and enables drilling in an upward or downward direction at similar or identical penetration rates, whereas prior art methods generally took several times as long to drill in a downward direction as in an upward direction. Even utilizing the method of this invention, it is still necessary to periodically survey the borehole to assure that it is within the upper and lower boundaries of the formation being drilled. However, the frequency of the required surveys is reduced when this invention is utilized, resulting in reduced expense and time for drilling a particular borehole.

The essential elements of the method of this invention involve first determining a value for drill bit revolutions per unit length of borehole drilled which will provide an upward change in borehole trajectory, determining a second value for drill bit revolutions per unti length of borehole drilled which will provide a downward change in borehole trajectory, and utilizing one of these values for drilling a portion of the borehole. In actual practice, the two values for drill bit revolutions per unit length of borehole will be used alternatively as determined by experience and confirmed by periodic borehole surveys to assure that the borehole is maintained within the formation being drilled.

The use of the method of this invention results in a reliable borehole trajectory for long distances through a formation, and enables a borehole to be drilled at a faster rate than could be reliably utilized using prior art techniques. Also, the degree of operator training required is substantially reduced when this invention is utilized, as a single variable is used to determine the borehole path.

The foregoing description is intended to be illustrative rather than limiting, and it will be apparent to those skilled in the art that different values for the drilling conditions may be required in different circumstances, but the principals of the invention are applicable in general to drilling of horizontal boreholes through subterranean formations.

I claim:

1. A method of controlling the direction of a generally horizontal borehole being drilled with a rotary drilling unit in a subterranean formation such as a coal seam comprising:

(a) predetermining a set of drilling conditions for the formation being drilled and the equipment being utilized which will provide a substantially level borehole trajectory, said conditions including the number of drill bit revolutions per unit length of borehole drilled;

(b) predetermining a set of drilling conditions for the formation being drilled and the equipment being utilized which will provide an upward change in borehole trajectory, said conditions including the number of drill bit revolutions per unit length of borehole drilled;

(c) predetermining a set of drilling conditions for the formation being drilled and the equipment being utilized which will provide a downward change in borehole trajectory, said conditions including the number of drill bit revolutions per unit length of borehole drilled;

(d) determining the trajectory of the borehole being drilled and the borehole position relative to the upper or lower boundary of said formation; and (e) drilling a portion of said borehole utilizing one of the predetermined sets of conditions to maintain the borehole within the upper and lower boundaries of said formation.

2. The method of claim 1 wherein the borehole position and trajectory are periodically determined, and one of the predetermined sets of conditions is utilized after each periodic determination.

* * * * *